US007936365B2

(12) United States Patent
Jeong

(10) Patent No.: US 7,936,365 B2
(45) Date of Patent: May 3, 2011

(54) PRINTING METHOD AND APPARATUS USING SHUTTLE THERMAL PRINT HEAD

(75) Inventor: Jin-Wook Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1580 days.

(21) Appl. No.: 11/170,645

(22) Filed: Jun. 30, 2005

(65) Prior Publication Data

US 2006/0012664 A1 Jan. 19, 2006

(30) Foreign Application Priority Data

Jul. 19, 2004 (KR) ..... 10-2004-0055887
Jul. 19, 2004 (KR) ..... 10-2004-0055888
Jul. 19, 2004 (KR) ..... 10-2004-0055889

(51) Int. Cl.
*B41J 2/325* (2006.01)

(52) U.S. Cl. ..... 347/215
(58) Field of Classification Search ..... 347/215, 347/171, 176, 37
See application file for complete search history.

(56) References Cited

U.S. PATENT DOCUMENTS

| | | | | |
|---|---|---|---|---|
| 4,611,217 | A * | 9/1986 | Iizuka et al. | 347/176 |
| 5,289,208 | A | 2/1994 | Haselby | |
| 5,929,889 | A * | 7/1999 | Narita et al. | 347/171 |
| 2004/0252159 | A1 * | 12/2004 | Sato | 347/37 |

FOREIGN PATENT DOCUMENTS

| | | |
|---|---|---|
| CN | 1310669 A | 8/2001 |
| JP | 63-141780 | 6/1988 |
| JP | 06-226964 | 8/1994 |
| JP | 06-305198 | 11/1994 |
| JP | 07-076136 | 3/1995 |
| JP | 07-108691 | 4/1995 |
| JP | 08-324009 | 12/1996 |
| JP | 10-016271 | 1/1998 |
| JP | 11-320808 | 11/1999 |
| JP | 2000-037892 | 2/2000 |
| JP | 2000-108397 | 4/2000 |
| JP | 2001-063022 | 3/2001 |
| JP | 2001-277571 | 10/2001 |
| JP | 2003-054061 | 2/2003 |
| KR | P1994-0010657 | 5/1994 |
| KR | P1996-0010256 | 4/1996 |
| KR | P1998-0000945 | 3/1998 |
| KR | P1998-0032993 | 7/1998 |
| KR | P1998-0077796 | 11/1998 |
| KR | 1999-0038218 | 6/1999 |
| KR | P1999-0055080 | 7/1999 |
| KR | P1999-0056840 | 7/1999 |
| KR | P1999-0059361 | 7/1999 |
| KR | P2003-0094122 | 12/2003 |
| WO | 02/096651 | 12/2002 |

* cited by examiner

*Primary Examiner* — K. Feggins
(74) *Attorney, Agent, or Firm* — Roylance, Abrams, Berdo and Goodman, L.L.P.

(57) ABSTRACT

A printing method and apparatus using a shuttle thermal print head (TPH), which can print by moving the TPH in a transverse direction. The apparatus and printing method include (a) printing an image on a medium using the TPH while feeding the medium in a positive longitudinal direction; (b) moving the TPH in the transverse direction by a predetermined value; and (c) printing an image on the medium using the TPH while feeding the medium in a negative longitudinal direction.

16 Claims, 18 Drawing Sheets

FIG. 15A
FIG. 15B
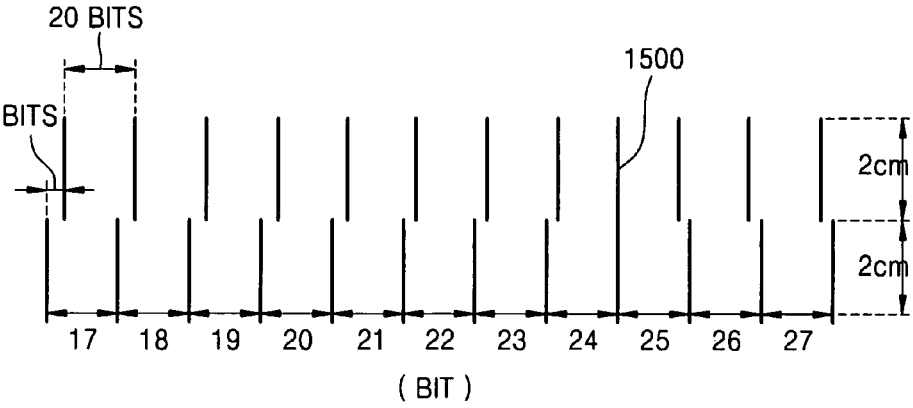
FIG. 16
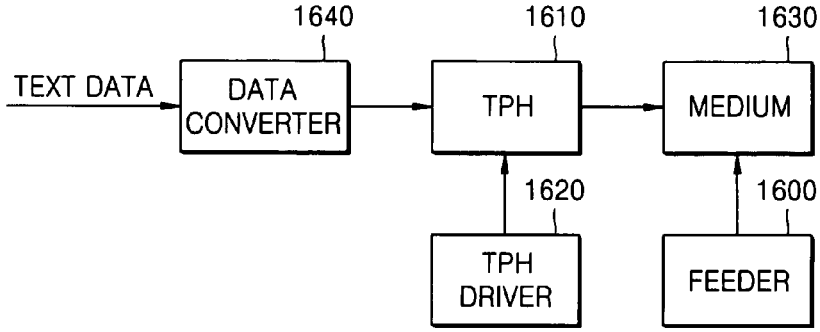

PRINTING METHOD AND APPARATUS USING SHUTTLE THERMAL PRINT HEAD

BACKGROUND OF THE INVENTION

This application claims the benefit under 35 U.S.C. 119(a) of Korean Patent Application Nos. 10-2004-0055887, filed on Jul. 19, 2004, 10-2004-0055888, filed on Jul. 19, 2004 and 10-2004-0055889, filed on Jul. 19, 2004, respectively, in the Korean Intellectual Property Office, the entire disclosures of which are hereby incorporated by reference.

1. Field of the Invention

The present invention relates to a printing method and apparatus using a thermal print head (TPH). More particularly, the present invention relates to a printing method and apparatus using a shuttle TPH, which can print an image by moving the TPH in a transverse direction.

2. Description of the Related Art

A thermal transfer printing apparatus forms an image by transferring ink to a medium by heating an ink ribbon attached to the medium using a thermal print head (TPH) or forms an image by heating a medium on which an ink layer of a predetermined color is formed in response to heat emitted by a TPH.

FIG. 1 is a schematic top view of a conventional thermal transfer printing apparatus. Referring to FIG. 1, the printing apparatus includes a thermal print head (TPH) 100, a TPH nozzle 120, a platen roller 140, and a feeder 155. The feeder 155 includes a motor 160, a driving roller 170, a following roller 180, and a media sensor 190.

The TPH 100 heats a medium fed by the feeder 155. The TPH nozzle 120 supplies ink required for printing onto the platen roller 140. The platen roller 140 is placed in front of the TPH 100 while a medium is inserted between the platen roller 140 and the TPH 100, supports the medium for ink to adhere thereto, and rotates when the medium is fed.

The motor 160 is a power source for supplying a printing medium to the TPH 100, and the driving roller 170 feeds the medium by being engaged with the motor 140 and rotating. The following roller 180 feeds the medium by being engaged with the driving roller 170 and rotating while the medium is inserted between the driving roller 170 and the following roller 180. The media sensor 190 detects a position of the printing medium.

FIG. 2 is an image printed using the conventional thermal transfer printing apparatus of FIG. 1. The image shown in FIG. 2 is printed using a TPH having heating elements corresponding to 300 dots per inch (dpi), and a printing resolution is also 300 dpi, equal to the number of heating elements of the TPH.

As described above, when the conventional thermal transfer printing apparatus is used, since a printing region having a transverse length longer than a length of a TPH cannot be printed, the size of the TPH must be increased to print on a large sized medium. Therefore, manufacturing costs power consumption and heat dissipation increase.

Also, when the conventional thermal transfer printing apparatus is used, printing is performed with only a predetermined resolution according to the number of heating elements of the TPH. Therefore, since the number of heating elements of the TPH must be increased to perform high quality printing by increasing the printing resolution, the manufacturing cost increases, and the temporary consumption of power and heat dissipation of the printing apparatus increases.

Also, when heat is applied on a medium using two TPHs in order to perform color printing on the medium, a color to be printed may not be printed due to a distance deviation between the two TPHs. Therefore, an alignment compensation for matching positions of the two TPHs is required.

Therefore, there is a need for a TPH that can print on a large sized medium without greatly increasing power consumption or heat dissipation.

SUMMARY OF THE INVENTION

Embodiments of the present invention provide a printing method and apparatus using a small sized shuttle thermal print head (TPH), which can print on a large sized medium by moving the TPH in a transverse direction.

Embodiments of the present invention also provide a TPH alignment compensation method and apparatus which can conveniently and correctly compensate for the alignment of two TPHs by detecting a deviation in the distance between the two TPHs from respective printing patterns of the two TPHs and moving the two TPHs by the detected distance deviation using drivers attached to the TPHs.

Embodiments of the present invention also provide a high quality printing method and apparatus using a shuttle TPH, which can print with high resolution using the TPH having a small number of heating elements by moving the TPH in a transverse direction.

According to an aspect of the present invention, there is provided a printing method using a thermal print head (TPH). The method comprising (a) printing an image on a medium using the TPH while feeding the medium in a longitudinal direction; (b) moving the TPH in a transverse direction by a predetermined value; and (c) printing an image on the medium using the TPH while feeding the medium in a longitudinal direction. The longitudinal direction is a lengthwise direction of the medium fed by a feeder, and the transverse direction is a widthwise direction of the medium crossing the longitudinal direction at a right angle.

The predetermined value in operations (b) may be a transverse length of the TPH.

Operation (c) may comprise calculating a transverse length of a region to be printed which remained on the medium and comparing the calculated transverse length with the transverse length of the TPH; printing an image on the medium using the entire portion of the TPH while moving the medium in the longitudinal direction if the calculated transverse length is larger than the transverse length of the TPH; and printing an image on the medium using only a partial portion of the TPH corresponding to the calculated transverse length while moving the medium in the longitudinal direction if the calculated transverse length is smaller than the transverse length of the TPH.

The TPH may comprise a first TPH for heating a medium to print at least one of yellow, magenta, and cyan data; and a second TPH for heating the medium to print the data remaining except the data printed by the first TPH.

When the TPH comprises the first and second TPHs, operation (a) may comprise printing an image on the medium by the first TPH heating the medium and then by the second TPH heating the medium while feeding the medium in the positive longitudinal direction. Also, operation (c) may comprise printing the medium by the second TPH heating the medium and then by the first TPH heating the medium while feeding the medium in the negative longitudinal direction.

The method may further comprise (d) determining whether a region to be printed remains on the medium; and (e) printing an image on the medium using the TPH while moving the medium in the positive longitudinal direction after moving the TPH in the transverse direction by a predetermined value if the region to be printed remains on the medium.

Operation (e) may comprise (e1) calculating a transverse length of the region to be printed which remained on the medium if the region to be printed remains and comparing the calculated transverse length with the transverse length of the TPH; (e2) printing an image on the medium using the entire portion of the TPH while moving the medium in the positive longitudinal direction if the calculated transverse length is larger than the transverse length of the TPH;,and (e3) printing an image on the medium using only a partial portion of the TPH corresponding to the calculated transverse length while moving the medium in the positive longitudinal direction if the calculated transverse length is smaller than the transverse length of the TPH.

According to another aspect of the present invention, there is provided a printing apparatus using TPH, the apparatus comprising a feeder for feeding a medium in a positive/negative longitudinal direction; a TPH for printing an image by heating the medium fed by the feeder; and a TPH driver moving the TPH in the transverse direction.

The TPH driver may comprise a printing determinator for determining whether a region to be printed remains on the medium; and a driver for moving the TPH in the transverse direction by a predetermined value if the region to be printed remains on the medium.

The predetermined value may be a transverse length of the TPH.

The apparatus may further comprise a TPH controller for controlling the TPH to heat the media using only a partial portion of the TPH corresponding to the region to be printed which remained on the medium.

The TPH controller may comprise a length calculator for calculating a transverse length of the region to be printed which remained on the medium; a length comparator for comparing the calculated transverse length with the transverse length of the TPH; and a bit controller for controlling the TPH to heat the medium using the entire portion of the TPH if the calculated transverse length is larger than the transverse length of the TPH and using only a partial portion corresponding to the calculated transverse length if the calculated transverse length is smaller than the transverse length of the TPH.

The TPH driver may further comprise a motor for moving the TPH; an encoder for converting a rotational angle of the motor into an electrical signal and outputting the electrical signal; a distance calculator for calculating a moving distance of the TPH using the electrical signal; and a motor controller for controlling the motor operation using the calculated moving distance and the predetermined value.

The TPH may comprise a first TPH for heating the medium to print at least one of yellow, magenta, and cyan data; and a second TPH for heating the medium to print the data remaining except the data printed by the first TPH.

When the TPH comprises the first and second TPHs, the TPH driver may comprise a first TPH driver moving the first TPH in the transverse direction; and a second TPH driver moving the second TPH in the transverse direction.

The printing method using a TPH may be realized by a computer-readable medium having recorded thereon a computer-readable program for performing the method.

According to another aspect of the present invention, there is provided a method of detecting a distance deviation between two TPHs of a printing apparatus which uses a first TPH and a second TPH printing an image by heating a medium. The method comprising (a) printing a first pattern on the medium using the first TPH and printing a second pattern on the medium using the second TPH; and (b) detecting the distance deviation between the first TPH and the second TPH using the printed patterns.

Operation (a) may comprise printing the first pattern on the medium by the first TPH for heating the medium at a predetermined constant interval; and printing the second pattern on the medium by the second TPH for heating the medium at the constant interval.

Operation (a) may comprise printing the first pattern on the medium by the first TPH for heating the medium at a predetermined constant interval; and printing the second pattern on the medium by the second TPH for heating the medium by starting from at an interval below the constant interval and gradually enlarging the interval.

Operation (b) may comprise detecting a matched printing position of the printed first and second patterns; and calculating the distance deviation between the first TPH and the second TPH using the detected printing position.

According to another aspect of the present invention, there is provided a TPH alignment compensation method of a printing apparatus which uses a first TPH and a second TPH for printing an image by heating a medium. The method comprising moving the first TPH or the second TPH by a distance deviation between the two TPHs using a driver for moving the first TPH and the second TPH.

According to another aspect of the present invention, there is provided a TPH alignment compensation apparatus comprising a feeder for feeding a medium including color layers for color printing; a first TPH for printing a first pattern using at least one among color layers of the medium; a second TPH for printing a second pattern using color layers remaining except the color layers printed by the first TPH from the color layers of the medium; a TPH driver for moving the first TPH and the second TPH; a distance deviation detector for calculating a distance deviation between the first TPH and the second TPH by detecting the first pattern and the second pattern; and a controller for controlling the feeder and the first and second TPHs so that the first and second TPHs print the first and second patterns on the medium, respectively, and controlling the TPH driver to compensate for a position of the first TPH or the second TPH by the distance deviation.

The controller may comprise a pattern printing controller for controlling the feeder and the first and second TPHs so that the first TPH prints the first pattern by heating the medium at a predetermined constant heating interval and the second TPH prints the second pattern by heating the medium by starting from an interval below the constant heating interval and gradually enlarging the interval; and a driving controller for controlling the TPH driver to move the first TPH or the second TPH by the distance deviation.

The TPH alignment compensation method may be realized by a computer-readable medium having recorded thereon a computer-readable program for performing the method.

According to another aspect of the present invention, there is provided a high quality printing method using TPH printing an image by heating a medium. The method comprising (a) converting image data into data to be printed with a predetermined resolution; (b) printing the converted data on the medium using the TPH while feeding the medium in a positive longitudinal direction; (c) moving the TPH in a transverse direction by a predetermined value; and (d) printing the converted data on the medium using the TPH while feeding the medium in a negative longitudinal direction.

In operation (a), the image data may be converted into the data to be printed with a predetermined resolution using a look-up table. In operation (c), the TPH may be moved in the transverse direction by the distance corresponding to 0.5 bit.

According to another aspect of the present invention, there is provided a high quality printing apparatus using TPH for printing an image by heating a medium. The apparatus comprising a data converter for converting image data into data to be printed with the predetermined resolution; a feeder for feeding the medium in a positive/negative longitudinal direction; a TPH for printing an image by heating the medium fed by the feeder; and a TPH driver for moving the TPH in the transverse direction by a predetermined value.

The data converter may convert the image data into the data to be printed with a predetermined resolution using a look-up table.

The high quality printing method using TPH may be realized by a computer-readable medium having recorded thereon a computer-readable program for performing the method.

BRIEF DESCRIPTION OF THE DRAWINGS

The above and other features and advantages of the present invention will become more apparent by describing in detail exemplary embodiments thereof with reference to the attached drawings in which:

FIG. 15A through 15B show first and second patterns printed using the alignment compensation method of FIG. 14 according to an embodiment of the present invention;

FIG. 16 is a block diagram of a high quality printing apparatus using a shuttle TPH according to an embodiment of the present invention;

Throughout the drawings, the same or similar elements, features and structures are represented by the same reference numerals.

DETAILED DESCRIPTION OF EXEMPLARY EMBODIMENTS

Hereinafter, the present invention will now be described more fully with reference to the accompanying drawings, in which embodiments of the invention are shown.

Figure 1:
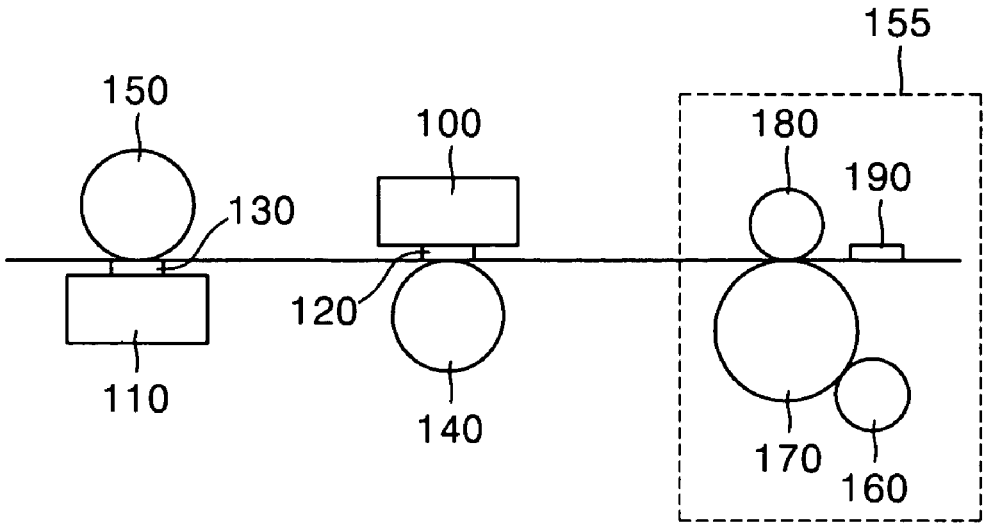
FIG. 1 (PRIOR ART)
FIG. 1 is a schematic top view of a conventional thermal transfer printing apparatus.
Figure 2:
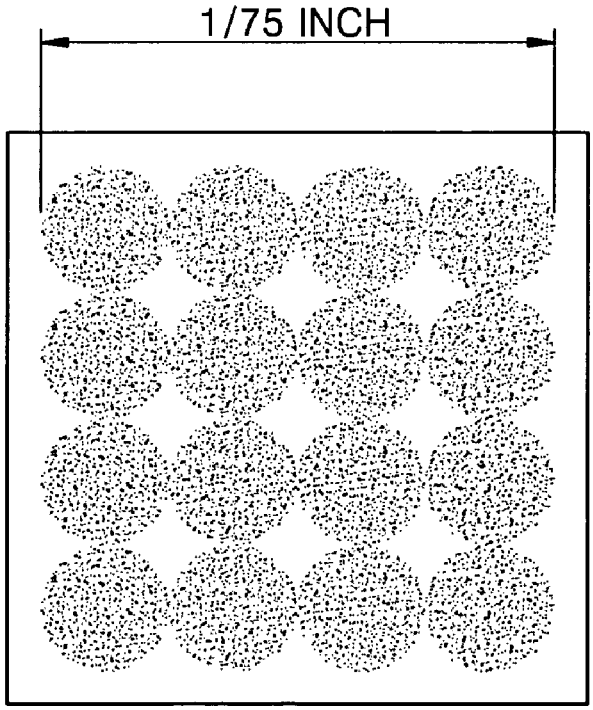
FIG. 2 (PRIOR ART)
FIG. 2 is an image printed using the conventional thermal transfer printing apparatus of FIG. 1.
Figure 3:
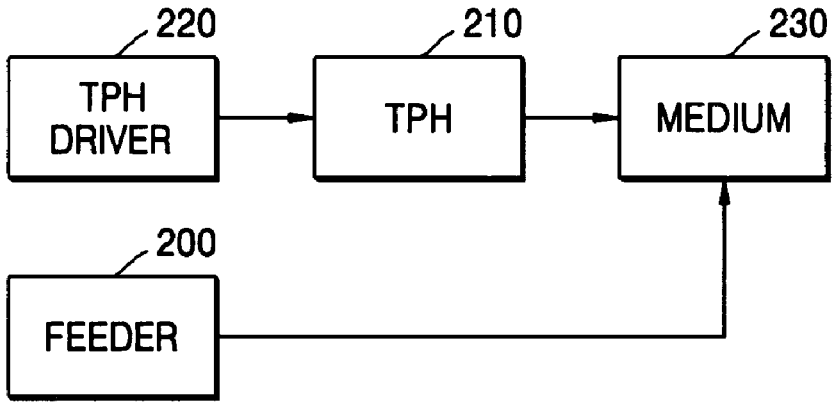
FIG. 3 is a block diagram of a printing apparatus using a shuttle thermal print head (TPH) according to an embodiment of the present invention.
Figure 8:
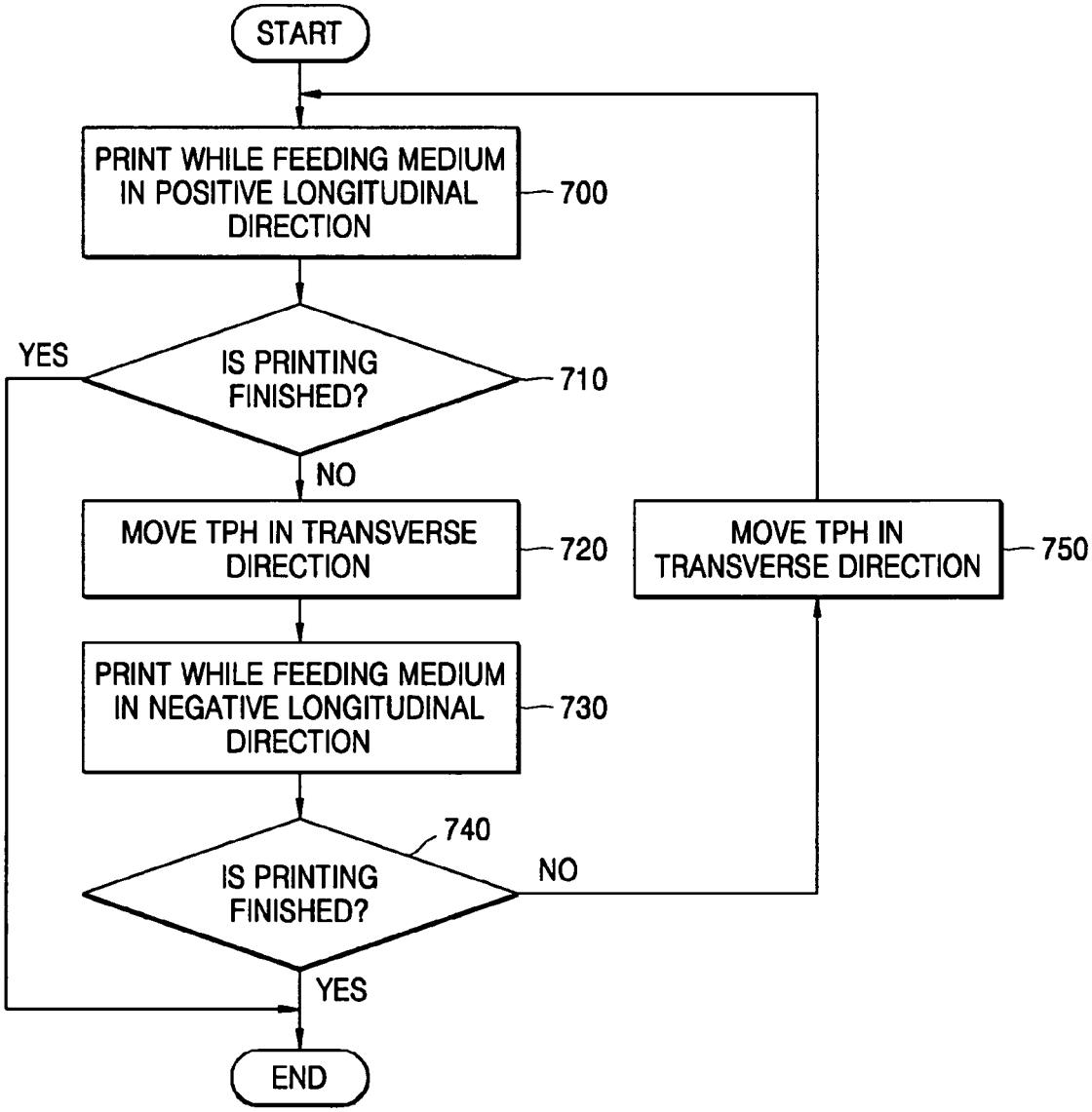
FIG. 8 is a flowchart illustrating a printing method using a shuttle TPH according to an embodiment of the present invention according to an embodiment of the present invention.

FIG. 3 is a block diagram of a printing apparatus using a shuttle TPH according to an embodiment of the present invention. Referring to FIG. 3, the printing apparatus comprises a feeder 200, a thermal print head (TPH) 210, and a TPH driver 220. An operation of the printing apparatus shown in FIG. 3 will now be described with reference to the flowchart illustrating a printing method using a shuttle TPH shown in FIG. 8.

In operation 700, the feeder 200 feeds a medium 230 in a positive longitudinal direction at a predetermined printing speed, and the TPH 210 prints an image by heating the medium 230 fed via the feeder 200. The longitudinal direction is a lengthwise direction of the medium 230 fed by the feeder 200.

The TPH driver 220 determines whether printing is finished in operation 710. If the printing is not finished, the TPH driver 220 moves the TPH 210 in a transverse direction by a predetermined value in operation 720. The predetermined value is a moving distance or displacement defined by a user and is preferably set to the transverse length of the TPH 210. The transverse direction is a widthwise direction of the medium 230 and crosses the longitudinal direction at a right angle.

In operation 730, the feeder 200 feeds the medium 230 in a negative longitudinal direction at a predetermined printing speed, and the TPH 210 prints an image by heating the medium 230 fed by the feeder 200.

The TPH driver 220 determines whether printing is finished on a printing region to be printed in operation 740. If the printing is not finished, the TPH driver 220 moves the TPH 210 in the transverse direction by a predetermined value in operation 750, and operations 700 through 750 are repeated.

Figure 4:
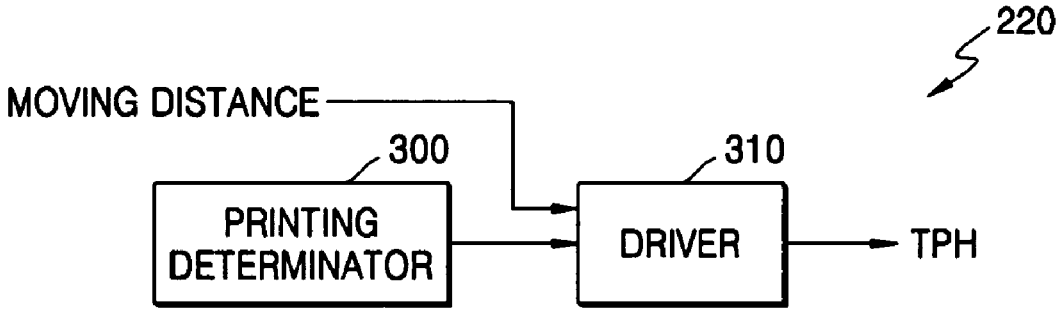
FIG. 4 is a detailed block diagram of a TPH driver of FIG. 3 according to an embodiment of the present invention.

FIG. 4 is a detailed block diagram of the TPH driver 220 of FIG. 3. Referring to FIG. 4, the TPH driver 220 comprises a printing determinator 300 and a driver 310.

The printing determinator 300 determines whether printing is finished on a printing region to be printed on the medium 230. The driver 310 receives a signal indicating whether the printing is finished from the printing determinator 300 and moves the TPH 210 in the transverse direction if the printing is not finished.

Figure 5:
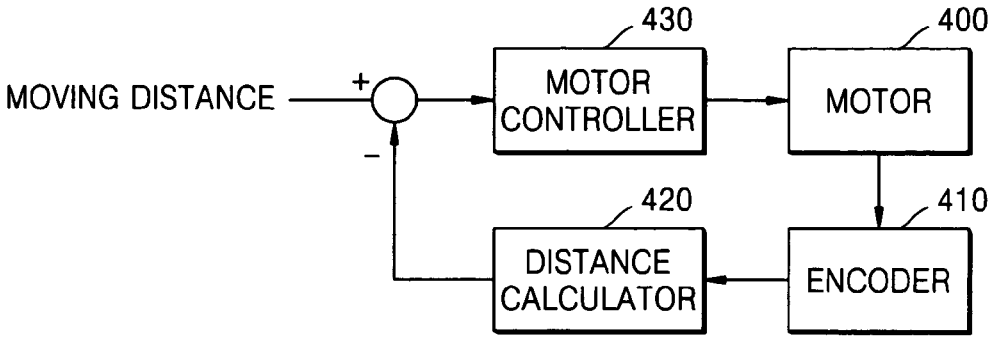
FIG. 5 is a block diagram of a controller of a motor for moving a TPH according to an embodiment of the present invention.

FIG. 5 is a block diagram of a controller of a motor 400 for moving the TPH 210 in the transverse direction. Referring to FIG. 5, the controller comprises an encoder 410, a distance calculator 420, and a motor controller 430.

The encoder 410 is attached to the motor 400, converts a rotation angle of the motor 400 into an electrical signal, and outputs the electrical signal. The distance calculator 420 calculates and outputs a moving distance or displacement of the TPH 210 by using the electrical signal output from the encoder 410.

The motor controller 430 receives a moving distance desired to move the TPH 210 and the actual moving distance of the TPH 210 output from the distance calculator 420 and controls the rotation angle of the motor 400 by controlling a voltage supplied to the motor 400. The motor controller 430 may be realized using a proportional integral derivative (PID), PI, P, or adaptive controller.

Figure 6:
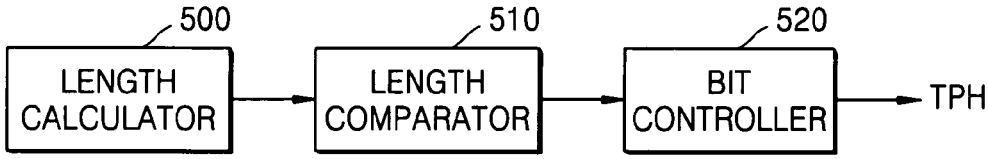
FIG. 6 is a block diagram of a controller for controlling a TPH according to an embodiment of the present invention.
Figure 10:
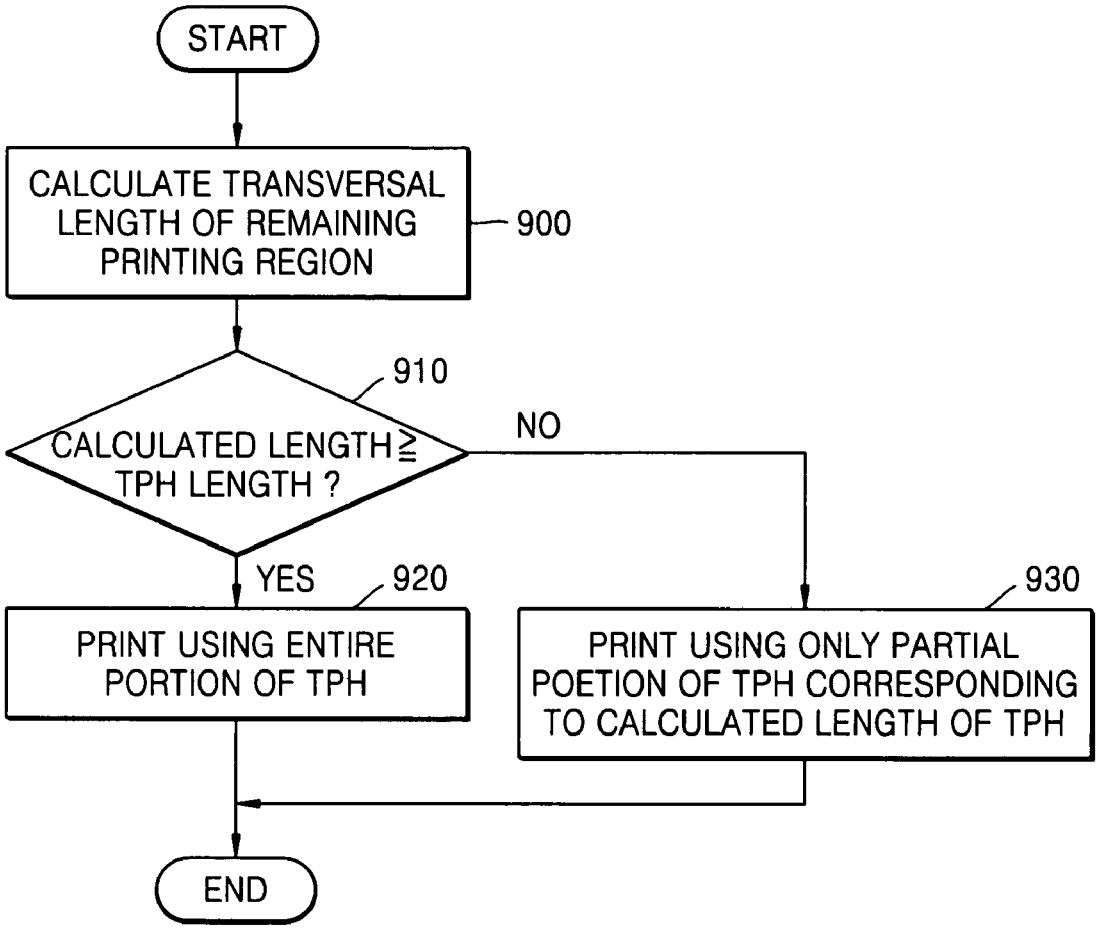
FIG. 10 is a flowchart illustrating an operation, in which a TPH prints an image on a medium, in FIG. 8 according to an embodiment of the present invention.

FIG. 6 is a block diagram of a controller for controlling the TPH 210. Referring to FIG. 6, the controller comprises a length calculator 500, a length comparator 510, and a bit controller 520. An operation of the controller shown in FIG. 6 will now be described with reference to the flowchart illustrating a method of printing an image while a medium is fed shown in FIG. 10.

The length calculator 500 calculates a transverse length of a remaining region to be printed in operation 900. When calculating the transverse length, for example, the transverse length of the remaining region to be printed can be calculated by storing a transverse length of a region to be printed and subtracting a moving distance from the stored transverse length of the region to be printed whenever the TPH 210 is moved in the transverse direction.

The length comparator 510 compares the calculated transverse length to the transverse length of the TPH 210 in operation 910. If the calculated transverse length of the remaining region to be printed is larger than the transverse length of the TPH 210, the bit controller 520 controls the TPH 210 to print using the entire portion of the TPH 210 in operation 920.

If the calculated transverse length of the remaining region to be printed is less than the transverse length of the TPH 210, the bit controller 520 controls the TPH 210 to print using only a partial portion of the TPH 210 corresponding to the calculated transverse length of the remaining region to be printed among the entire portion in operation 930.

For example, when printing is performed on a printing region eight inches wide and ten inches long using a 300 dpi TPH having three inches in length, if a printing region with a width of three inches is printed while the medium 230 is fed in the positive longitudinal direction, and if a printing region with a width of three inches is printed while the medium 230 is fed in the negative longitudinal direction, a transverse length of the remaining region to be printed is two inches. Therefore, the bit controller 520 controls the TPH 210 to print by heating the medium 230 using only 600 bits corresponding to two inches among the entire 900 bits.

Figure 9A:
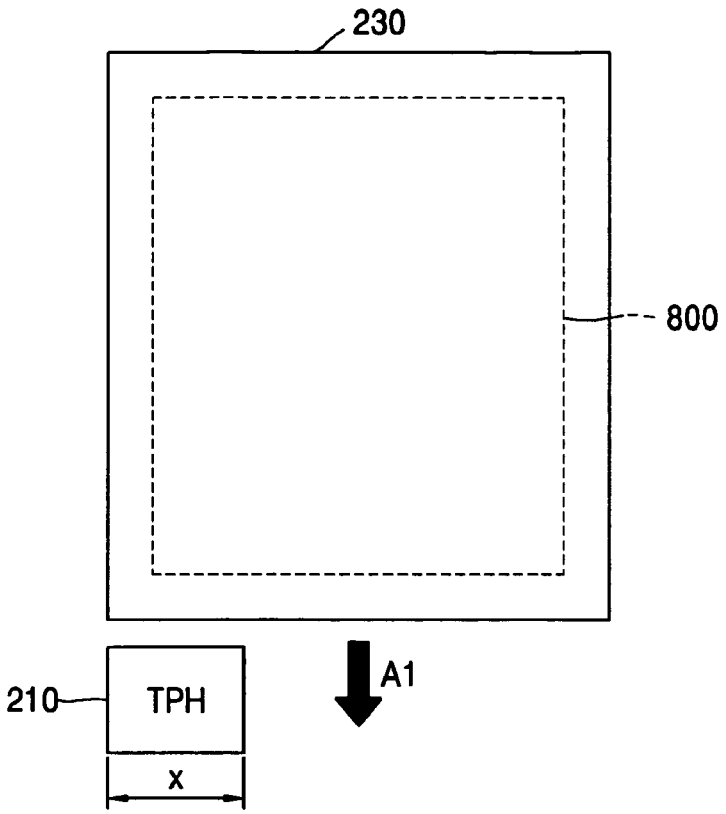
FIGS. 9A through 9C are examples of the printing method using a shuttle TPH according to an embodiment of the present invention.
Figure 9B:
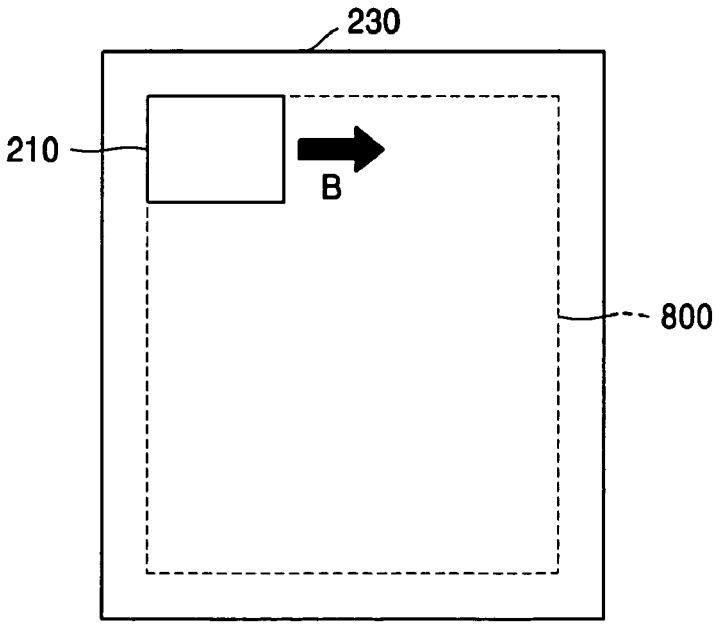
Figure 9C:
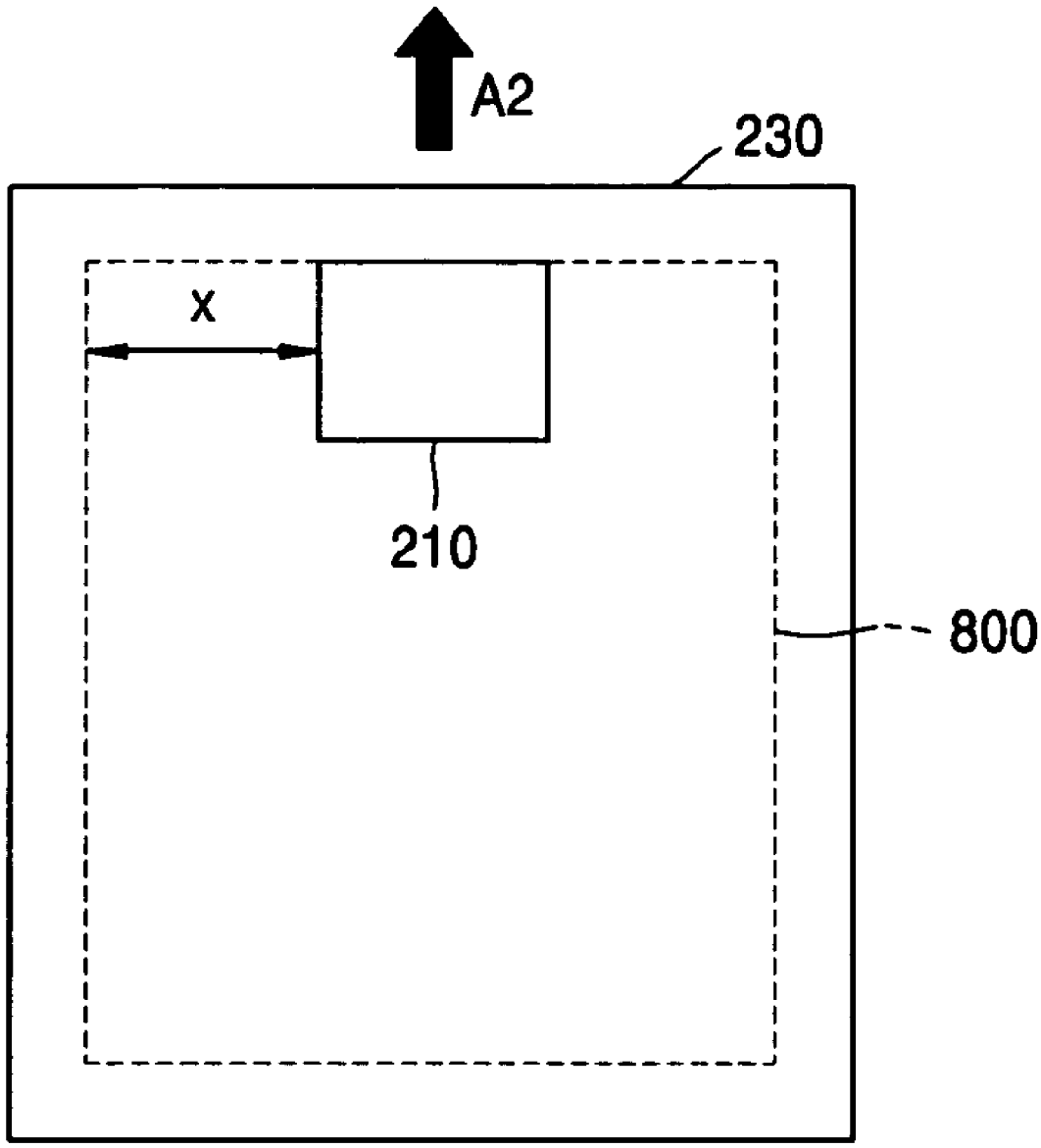

FIGS. 9A through 9C are examples of a printing method using the shuttle TPH. Referring to FIG. 9A, in order to print by heating a region 800 to be printed on the medium 230 using the TPH 210 with a length x, the medium 230 is fed in the positive longitudinal direction A1, and the TPH 210 prints by heating the fed medium 230.

Referring to FIG. 9B, after a printing region of the medium 230 corresponding to the transverse length x of the TPH 210 is printed by heating the medium 230 up to the end of the longitudinal direction of the medium 230, the TPH 210 is moved in the transverse direction B.

Referring to FIG. 9C, after the TPH 210 is moved in the transverse direction B by x, the medium 230 is fed in the negative longitudinal direction A2, and the TPH 210 prints on the medium 230 by repeating the above procedures until printing of the entire printing region 800 is finished.

Figure 7:
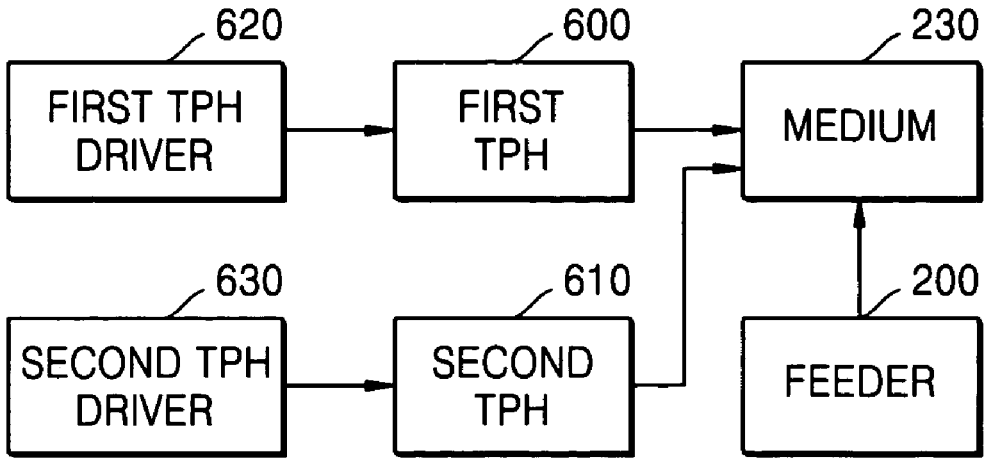
FIG. 7 is a block diagram of a printing apparatus using two shuttle TPHs according to an embodiment of the present invention.

FIG. 7 is a block diagram of a printing apparatus using two shuttle TPHs. Referring to FIG. 7, the printing apparatus comprises the feeder 200, a first TPH 600, a second TPH 610, a first TPH driver 620, and a second TPH driver 630. An operation of the printing apparatus shown in FIG. 7 will now be described with reference to the examples of the printing method using the two shuttle TPHs shown in FIGS. 11A through 11C.

Figure 11A:
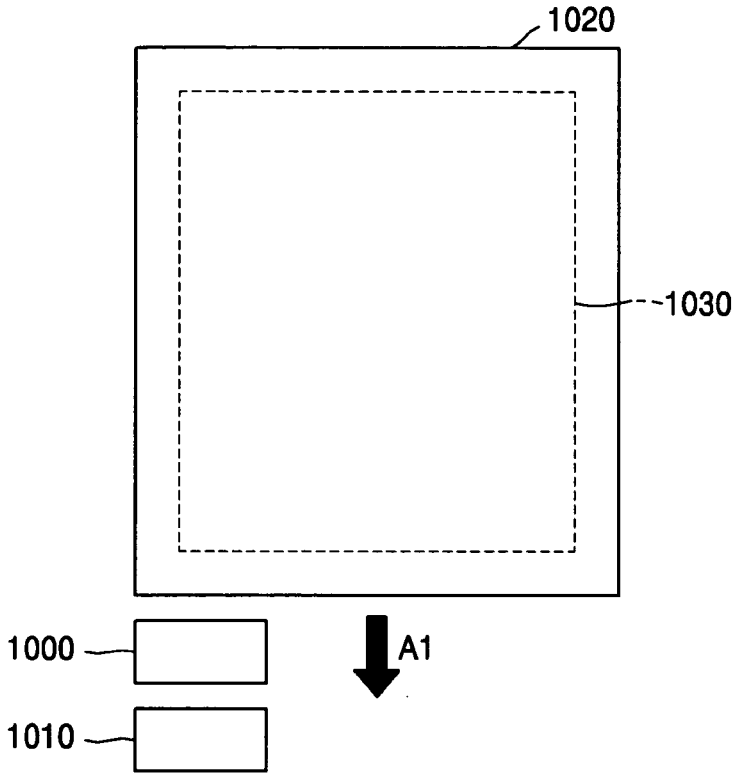
FIGS. 11A through 11C are examples of the printing method using two shuttle TPHs according to an embodiment of the present invention.

Referring to FIG. 11A, while the feeder 200 feeds the medium 230 in the positive longitudinal direction A1, the first TPH 600 prints by heating the fed medium 230 and then the second TPH 610 prints by heating the fed medium 230.

It is preferable that the medium 230 has ink layers of predetermined colors on both sides of a base sheet, and each ink layer has a single layer structure with a single color ink or a multiple layer structure for expressing more than two colors. For example, an ink layer of a first side of the medium 230 may have two layers for expressing yellow and magenta colors, and an ink layer of a second side of the medium 230 may have one layer for expressing a cyan color. The yellow and magenta colors of the ink layer of the first side can be selectively revealed by heating the medium 230 to a predetermined temperature based on a heating time of the first TPH 600. For example, when the first TPH 600 is heated for a short time at a high temperature, the yellow color may be revealed, and when the first TPH 600 is heated for a long time at a low temperature, the magenta color may be revealed. The cyan color of the ink layer of the second side may be revealed by heat applied by the second TPH 610.

Figure 11B:
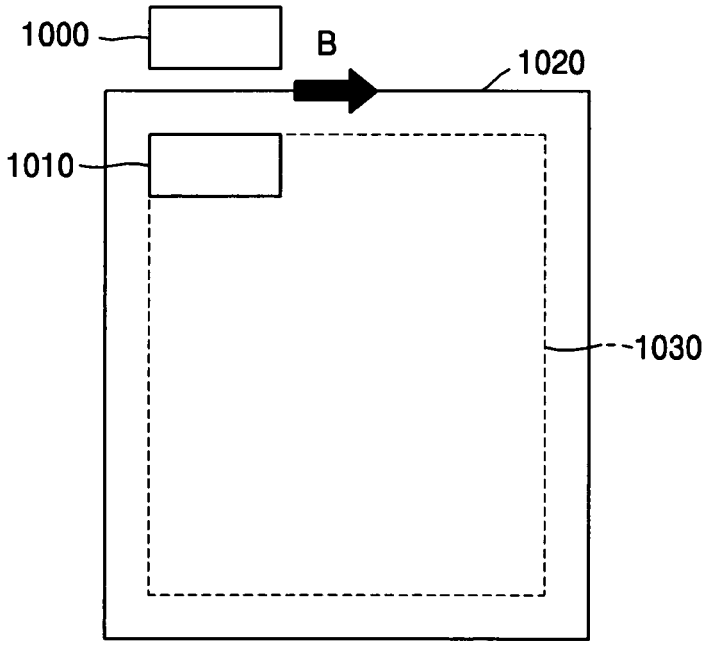

Referring to FIG. 11B, after the first TPH 600 and the second TPH 610 print by heating the medium 230 up to the end of the longitudinal direction, the first TPH 600 and the second TPH 610 are moved in the transverse direction B by the first TPH driver 620 and the second TPH driver 630, respectively.

Figure 11C:
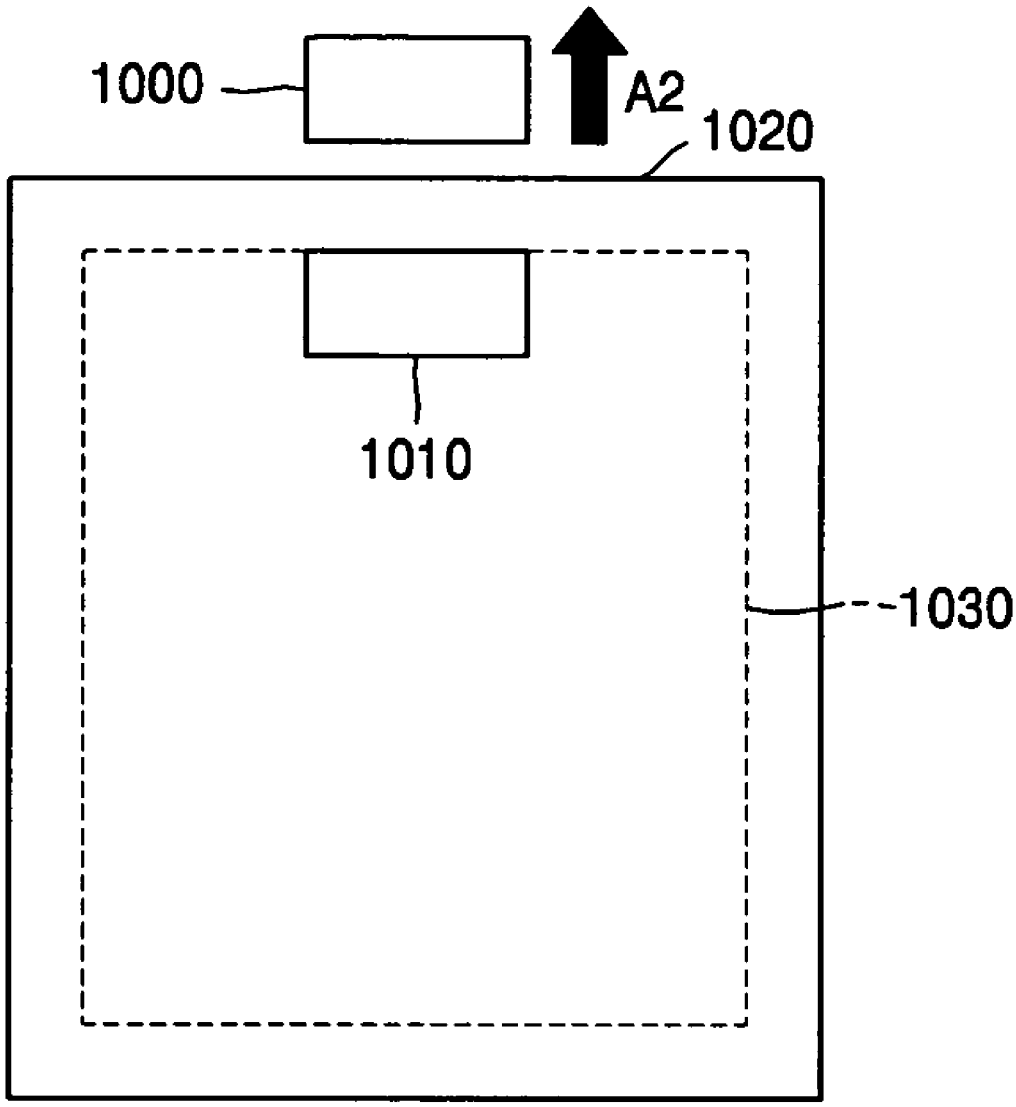

Referring to FIG. 11C, while the feeder 200 feeds the medium 230 in the negative longitudinal direction A2, the second TPH 610 prints by heating the fed medium 230, and then the first TPH 600 prints by heating the fed medium 230. The first TPH 600 and the second TPH 610 print on the medium 230 by repeating the above procedures until printing of the entire printing region 1000 is finished.

Figure 12:
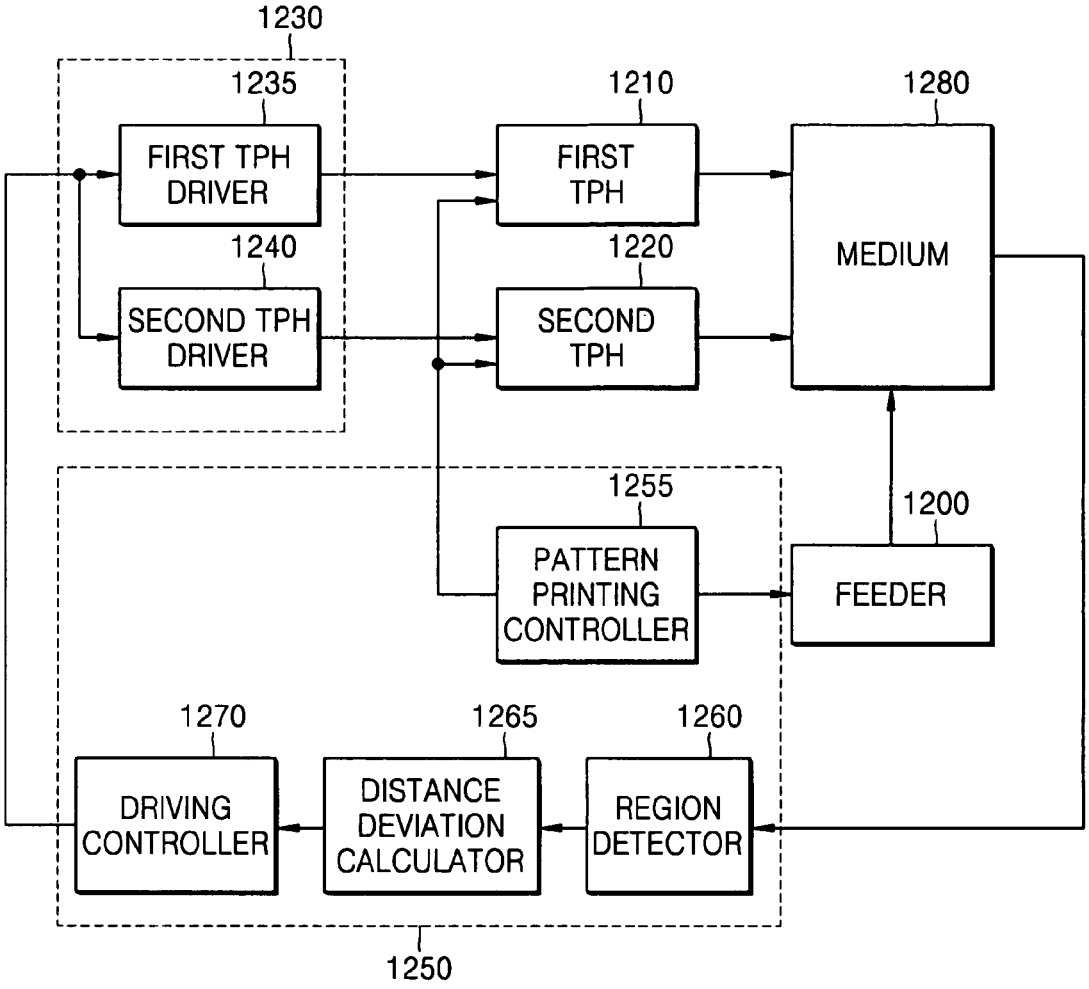
FIG. 12 is a block diagram of a TPH alignment compensation apparatus according to an embodiment of the present invention.
Figure 13:
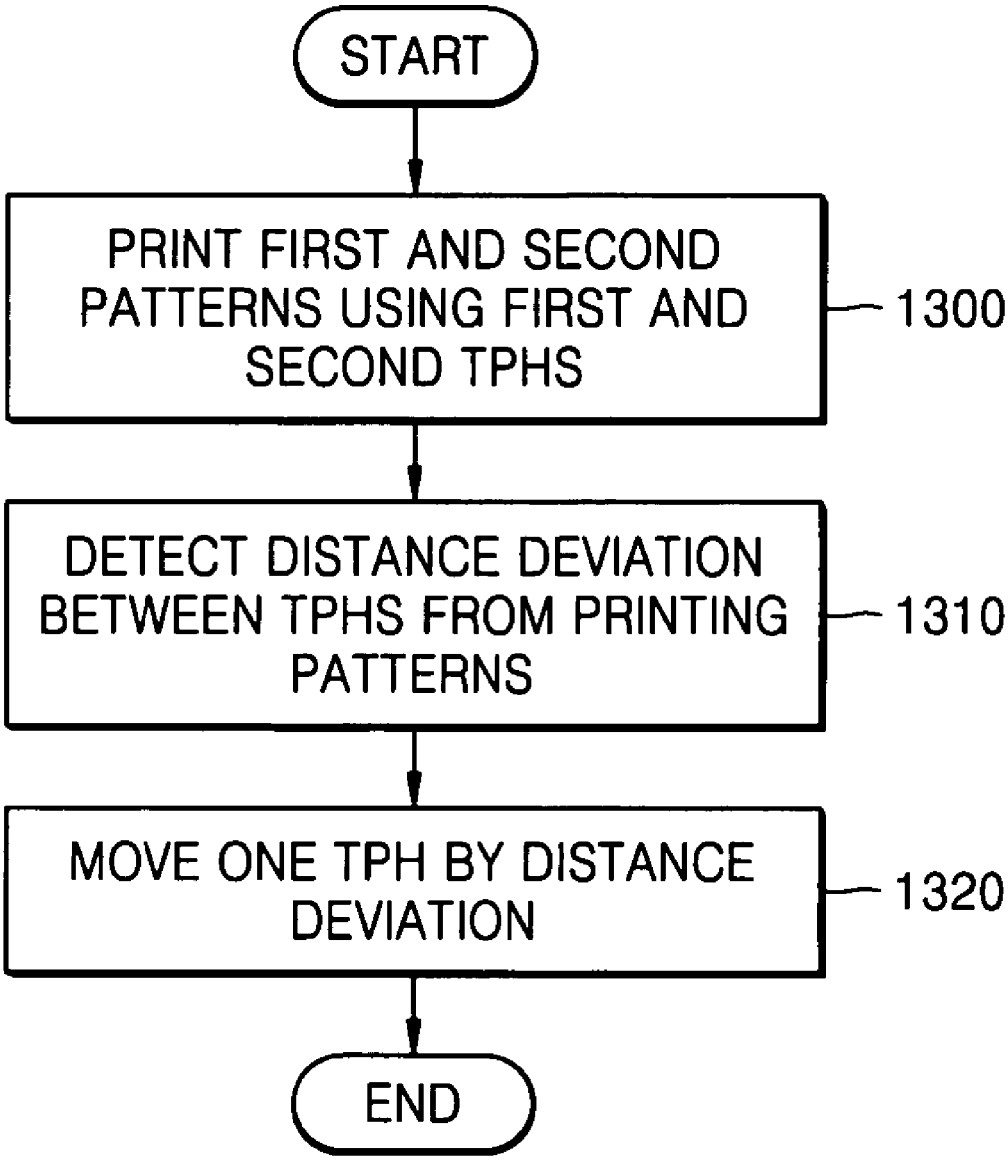
FIG. 13 is a flowchart illustrating a TPH alignment compensation method according to an embodiment of the present invention.

FIG. 13 is a flowchart illustrating a TPH alignment compensation method according to an embodiment of the present invention. The compensation method shown in FIG. 13 will now be described with reference to the TPH alignment compensation apparatus shown in FIG. 12.

In operation 1300, by being controlled by a controller 1250, a first TPH 1210 prints a first pattern by heating a medium 1280 fed in the longitudinal direction by a feeder 1200, and a second TPH 1220 prints a second pattern by heating the medium 1280 fed in the longitudinal direction by the feeder 1200.

The controller 1250 detects a transverse distance deviation between the first TPH 1210 and the second TPH 1220 using the printed first and second patterns in operation 1310.

In operation 1320, by being controlled by the controller 1250, a misalignment is compensated for by a first TPH driver 1235 moving the first TPH 1210 in the direction of the second TPH 1220 by the detected distance deviation or by a second TPH driver 1240 moving the second TPH 1220 in the direction of the first TPH 1210 by the detected distance deviation.

Figure 14:
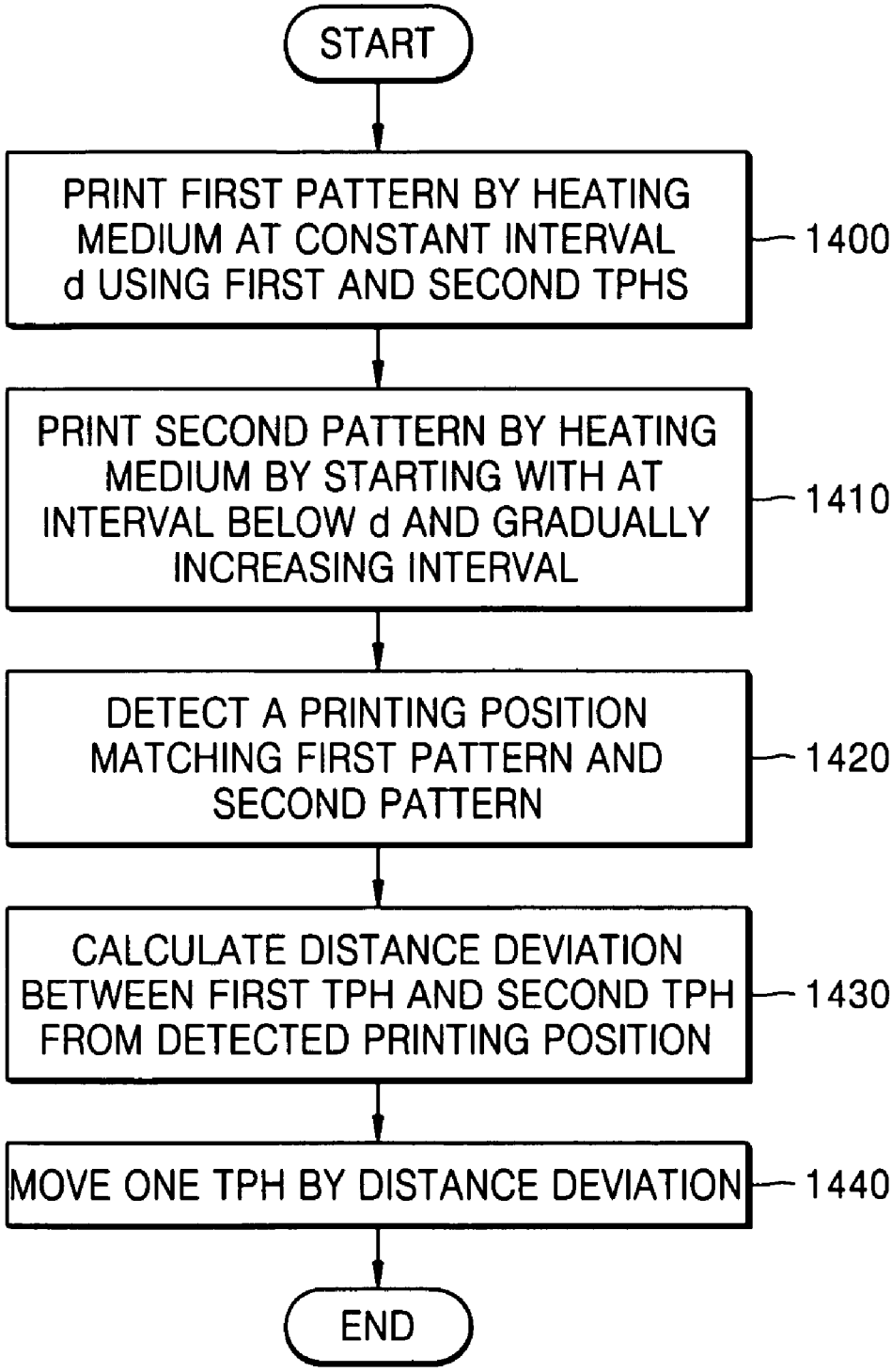
FIG. 14 is a detailed flowchart illustrating the TPH alignment compensation method of FIG. 13.

FIG. 14 is a detailed flowchart illustrating the TPH alignment compensation method of FIG. 13.

In operation 1400, the feeder 1200 feeds the medium 1280 in the longitudinal direction by a predetermined distance by being controlled by a pattern printing controller 1255, and the first TPH 1210 prints the first pattern by heating the medium 1280 fed at a constant heating interval d. FIG. 15A is an example of the first pattern printed in operation 1400. The first pattern shown in FIG. 15A shows a result printed by the first TPH 1210 heating the medium 1280 at a 20-bit interval while the feeder 1200 feeds the medium 1280 by 2 cm, for example. One bit represents a distance between adjacent heating elements of the first TPH 1210 or the second TPH 1220.

In operation 1410, the feeder 1200 feeds the medium 1280 in the longitudinal direction by a predetermined distance by being controlled by the pattern printing controller 1255, and the second TPH 1220 prints the second pattern by heating the medium 1280 by starting at an interval below the heating interval d and gradually enlarging the interval. FIG. 15B is an example of the second pattern printed in operation 1410. The second pattern shown in FIG. 15B shows a result printed by the second TPH 1220 heating the medium 1280 by starting at a 17-bit interval and enlarging the heating interval 1 bit by 1 bit while the feeder 1200 feeds the medium 1280 by 2 cm, for example.

A region detector 1260 detects a printing position where transverse positions are matched from the printed first and second patterns in operation 1420. It is preferable that in a method of detecting the matched position, a user directly selects the matched position by determining the first pattern and the second pattern with the naked eye or a printing position where transverse positions are matched from the printed first and second patterns is detected using a sensor.

By the method of detecting the matched position, a position 1500 where the first pattern shown in FIG. 15A and the second pattern shown in FIG. 15B are matched is detected.

A distance deviation calculator 1265 calculates a transverse distance deviation between the first TPH 1210 and the second TPH 1220 using the detected printing position in operation 1430. The calculating method of operation 1430 will now be described with reference to FIG. 15.

If a distance from a print beginning position of the first pattern to the detected printing position 500 is calculated, the distance corresponds to 160 bits (20 bits×8), and if a distance from a print beginning position of the second pattern to the detected printing position 500 is calculated, the distance corresponds to 164 bits (17+18+19+20+21+22+23+24).

Therefore, a distance corresponding to 4 bits, that is, a difference between the calculated distances, is a distance deviation between the first TPH 1210 and the second TPH 1220, and it can be calculated that the second TPH 1220 is placed on the left by the distance corresponding to 4 bits than the first TPH 1210. An actual distance deviation can be calculated by multiplying the distance deviation by a distance corresponding to 1 bit. For example, when each of the first TPH 1210 and the second TPH 1220 has heating elements of 300 dpi, the distance corresponding to 4 bits is 1/75 inch.

In operation 1440, by being controlled by a driving controller 1270, the first TPH driver 1235 and the second TPH driver 1240 compensate for a misalignment by moving the first TPH 1210 and the second TPH 1220 in the transverse direction by the calculated distance deviation so that transverse positions of the first TPH 1210 and the second TPH 1220 are matched. For example, it is preferable that the first TPH driver 1235 moves the first TPH 1210 in the direction of the second TPH 1220 by the calculated distance deviation or the second TPH driver 1240 moves the second TPH 1220 in the direction of the first TPH 1210 by the calculated distance deviation.

Figure 17:
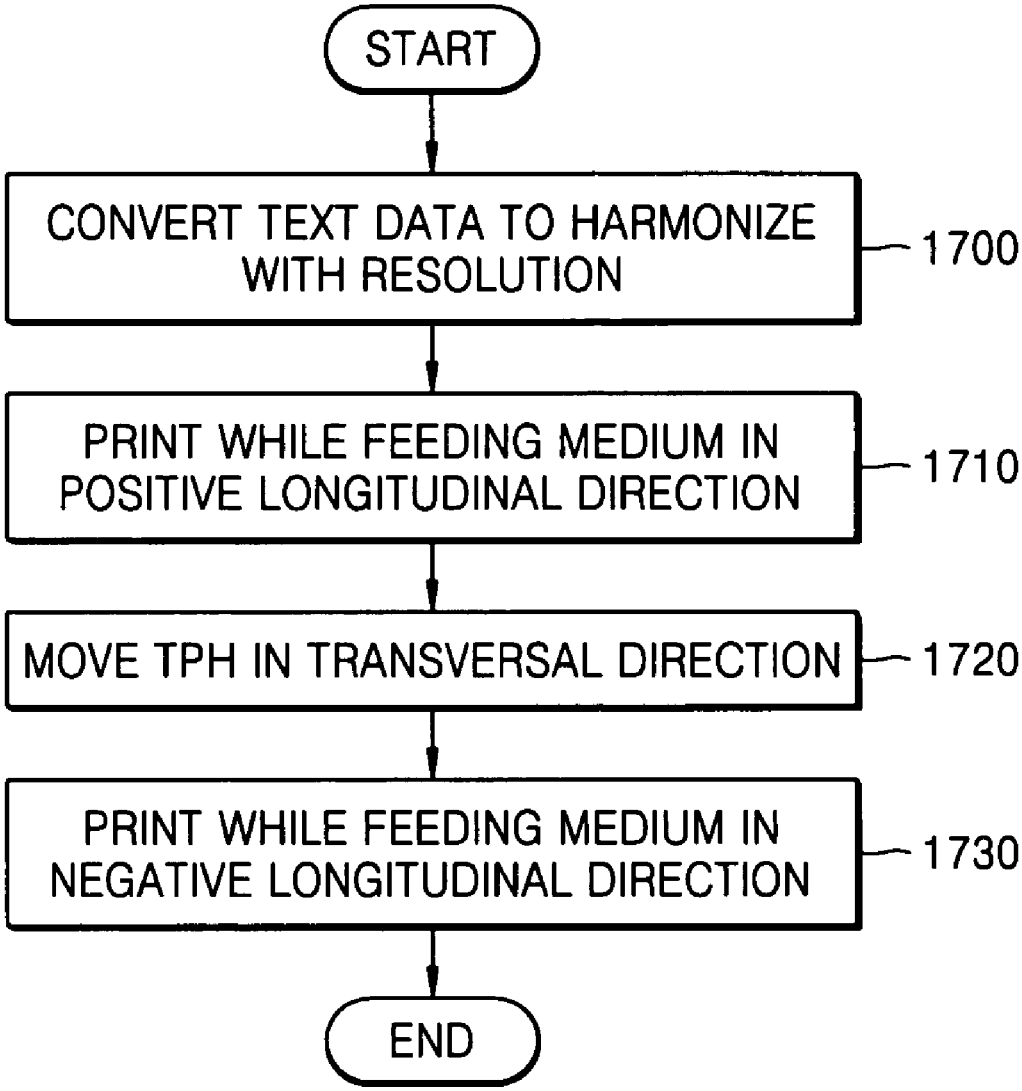
FIG. 17 is a flowchart illustrating a high quality printing method using a shuttle TPH according to an embodiment of the present invention.

FIG. 16 is a block diagram of a high quality printing apparatus using a shuttle TPH according to an embodiment of the present invention. Referring to FIG. 16, the high quality printing apparatus includes a feeder 1600, a TPH 1610, a TPH driver 1620, and a data converter 1640. The high quality printing apparatus shown in FIG. 16 will now be described with reference to the flowchart of FIG. 17 illustrating a high quality printing method.

The data converter 1640 converts image data to be printed, for example, yellow, magenta, and cyan data, into data of a predetermined resolution to be printed in operation 1700. For example, when data with 600 dpi resolution is printed using data with 300 dpi resolution, the data converter 1640 converts data so that a diameter of each dot of the data becomes half of the original dot.

The data converter 1640 can convert data by performing a calculation whenever image data is input. However, it is preferable that the data is converted using a predetermined look-up table by considering an increase of a calculating amount of the printing apparatus due to the conversion calculation. The look-up table stores image data and resolution as standard values and image data converted according to the resolution as reference values. Therefore, when image data to be printed is input, and when a printing resolution is selected, the data converter 1640 can convert data by referring to the look-up table without performing a separate calculation.

In operation 1710, the feeder 1600 feeds a medium 1630 in the positive longitudinal direction at a predetermined printing speed, and the TPH 1610 prints an image by heating the medium 1630 fed by the feeder 1600.

The TPH driver 1620 moves the TPH 1610 in the transverse direction by a predetermined value in operation 1720. It is preferable that the predetermined value is a distance corresponding to, for example, a 0.5 bit of the TPH 1610. For example, when the TPH 1610 has heating elements of 300 dpi, since 1 bit corresponds to 1/300 inch, the TPH driver 1620 moves the TPH 1610 in the transverse direction by 1/600 inch.

In operation 1730, the feeder 1600 feeds the medium 1630 in the negative longitudinal direction at a predetermined printing speed, and the TPH 1610 prints an image by heating the medium 1630 fed by the feeder 1600.

Figure 18A:
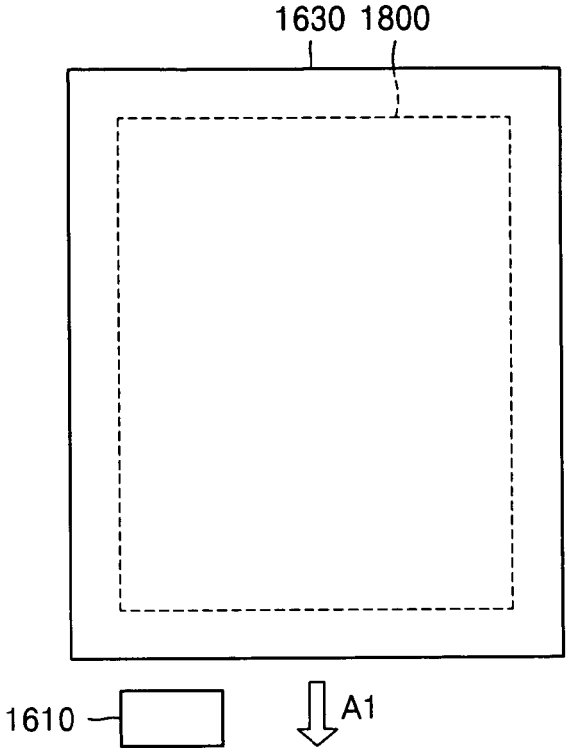
FIGS. 18A through 18C are examples obtained by a high quality printing method using a shuttle TPH according to an embodiment of the present invention.
Figure 18B:
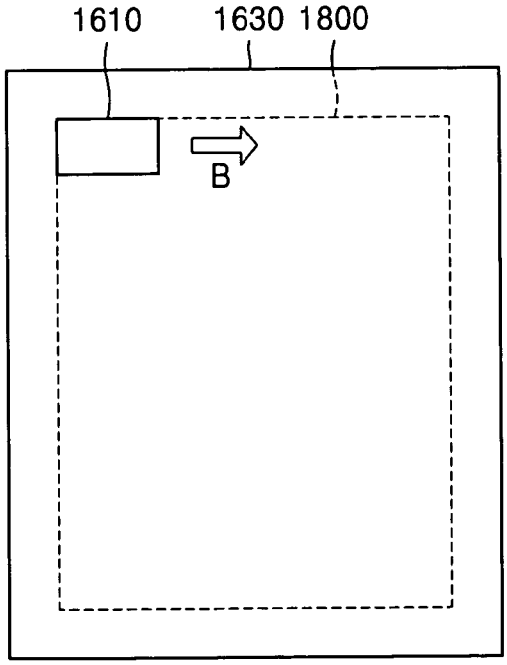
Figure 18C:
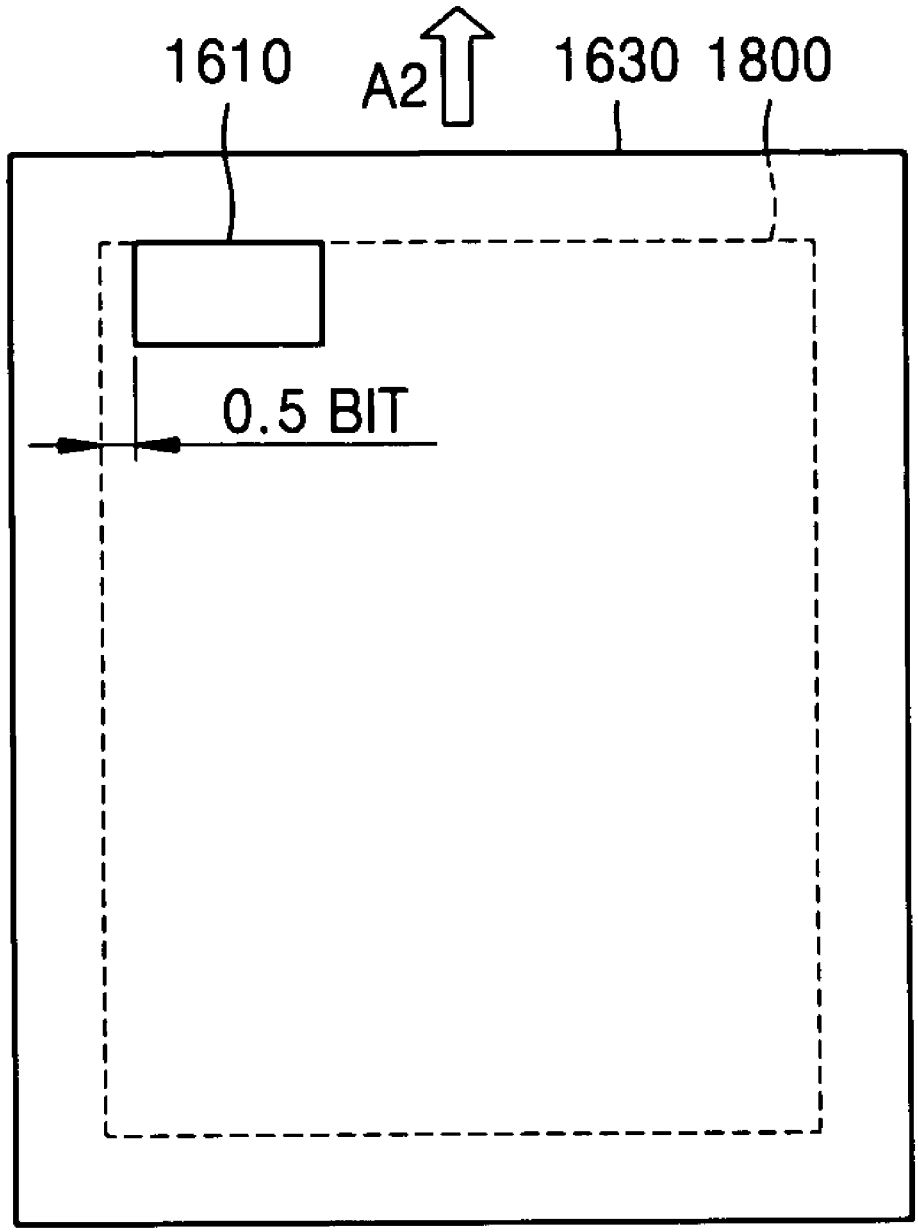

FIGS. 18A through 18C are examples of the high quality printing method using a shuttle TPH. Referring to FIG. 18A, to print by heating a region 1800 to be printed of the medium 1630 using the TPH 1610, the medium 1630 is fed in the positive longitudinal direction A1, and the TPH 1610 prints by heating the medium 1630 according to image data converted to a predetermined resolution.

Referring to FIG. 18B, the TPH 1610 is moved in the transverse direction B after printing.

Referring to FIG. 18C, after the TPH 1610 is moved in the transverse direction B by a distance corresponding to 0.5 bit, the medium 1630 is fed in the negative longitudinal direction A2, and the TPH 1610 prints by heating the medium 1630 according to image data converted to a predetermined resolution.

Figure 19:
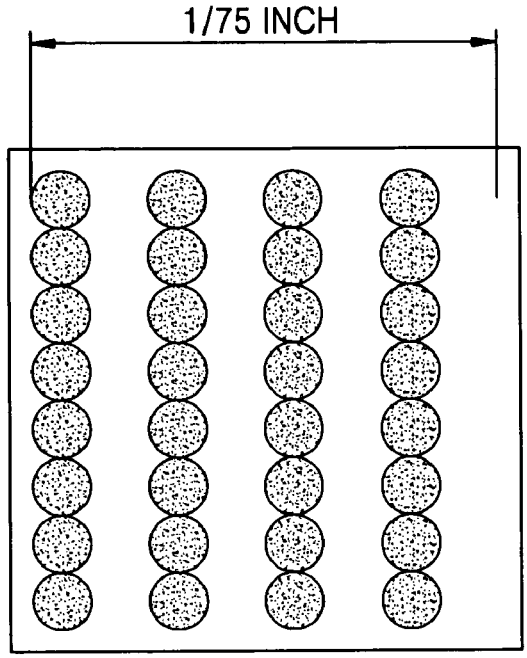
FIG. 19 shows a printing status after a first printing is performed in FIG. 18A according to an embodiment of the present invention.
Figure 20:
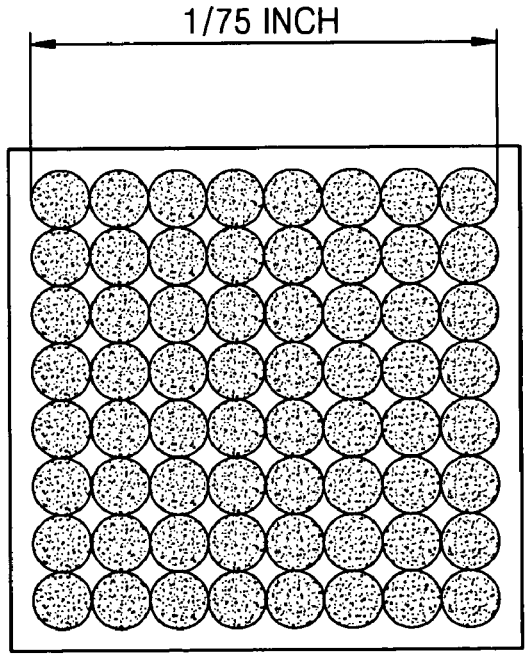
FIG. 20 shows a printing status after a second printing is performed in FIG. 18C according to an embodiment of the present invention.

FIG. 19 shows a printing status after a first printing is performed in FIG. 18A. FIG. 20 shows a printing status after a second printing is performed in FIG. 18C. The printing status shown in FIG. 19 is a result printed using the TPH 1610 having heating elements of 300 dpi. After the TPH 1610 performs the first printing, a 600 dpi resolution is obtained by moving the TPH 1610 in the transverse direction by 1/600 inch corresponding to a 0.5 bit and performing the second printing as shown in FIG. 20.

The embodiments of the present invention may be embodied in a general-purpose computer by running a program from a computer-readable medium, comprising but not limited to storage media such as magnetic storage media (ROMs, RAMs, floppy disks, magnetic tapes, etc.), optically readable media (CD-ROMs, DVDs, etc.), and carrier waves (transmission over the internet). The present invention may be embodied as a computer-readable medium having a computer-readable program code unit embodied therein for causing a number of computer systems connected via a network to effect distributed processing.

As described above, a printing method and apparatus using a shuttle TPH according to an embodiment of the present invention can print with high quality using a conventional small sized TPH without enlarging the size of the TPH even when a printing region of a medium is large by printing on the medium by moving the TPH in the transverse direction and reduce an increase of temporary power consumption and an increase of heating generated by using a large sized TPH. Also, a transverse distance deviation between two TPHs, which can be generated when printing is performed using the two TPHs, can be correctly compensated by moving one TPH in the transverse direction by the distance deviation.

While this invention has been particularly shown and described with reference to embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A printing method using a thermal print head (TPH), the method comprising:

(a) printing an image on a medium using the TPH while feeding the medium in a longitudinal direction;

(b) moving the TPH in a transverse direction by a predetermined value; and (c) printing an image on the medium using the TPH while feeding the medium in a longitudinal direction, wherein operation (c) comprises:

calculating a transverse length of a region to be printed which remained on the medium and comparing the calculated transverse length with the transverse length of the TPH;

printing an image on the medium using the entire portion of the TPH while moving the medium in the longitudinal direction if the calculated transverse length is larger than the transverse length of the TPH; and printing an image on the medium using only a partial portion of the TPH corresponding to the calculated transverse length while moving the medium in the longitudinal direction if the calculated transverse length is smaller than the transverse length of the TPH.

2. The method of claim 1, wherein the predetermined value in operation (b) is a transverse length of the TPH.

3. The method of claim 1, wherein the TPH comprises:

a first TPH for heating a medium to print at least one of yellow, magenta, and cyan data; and a second TPH for heating the medium to print the data remaining except the data printed by the first TPH.

4. The method of claim 3, wherein operation (a) comprises:

printing an image on the medium by the first TPH and then by the second TPH while feeding the medium in the positive longitudinal direction.

5. The method of claim 3, wherein operation (c) comprises:

printing an image on the medium by the second TPH and then by the first TPH while feeding the medium in the negative longitudinal direction.

6. A printing method using a thermal print head (TPH), the method comprising:

(a) printing an image on a medium using the TPH while feeding the medium in a longitudinal direction;

(b) moving the TPH in a transverse direction by a predetermined value;

(c) printing an image on the medium using the TPH while feeding the medium in a longitudinal direction;

(d) determining whether a region to be printed remains on the medium; and (e) printing an image on the medium using the TPH while moving the medium in the positive longitudinal direction after moving the TPH in the transverse direction by a predetermined value if the region to be printed remains on the medium, wherein operation (e) comprises :

(e1) calculating a transverse length of the region to be printed which remained on the medium and comparing the calculated transverse length with the transverse length of the TPH;

(e2) printing an image on the medium using the entire portion of the TPH while moving the medium in the positive longitudinal direction if the calculated transverse length is larger than the transverse length of the TPH; and (e3) printing an image on the medium using only a partial portion of the TPH corresponding to the calculated transverse length while moving the medium in the positive longitudinal direction if the calculated transverse length is less than the transverse length of the TPH.

7. A printing apparatus using a thermal print head (TPH), the apparatus comprising:

a feeder for feeding a medium in a positive and negative longitudinal direction;

a TPH for printing an image by heating the medium fed by the feeder;

a TPH driver for moving the TPH in a transverse direction; and a TPH controller for controlling the TPH to heat the media using only a partial portion of the TPH corresponding to the region to be printed which remained on the medium, wherein the TPH controller comprises:

a length calculator for calculating a transverse length of the region to be printed which remained on the medium;

a length comparator for comparing the calculated transverse length with the transverse length of the TPH; and a bit controller for controlling the TPH to heat the medium using the entire portion of the TPH if the calculated transverse length is larger than the transverse length of the TPH and using only a partial portion corresponding to the calculated transverse length if the calculated transverse length is less than the transverse length of the TPH.

8. The apparatus of claim 7, wherein the TPH driver further comprises:

a motor for moving the TPH;

an encoder for converting a rotation angle of the motor into an electrical signal and outputting the electrical signal;

a distance calculator for calculating a moving distance of the motor using the electrical signal; and a motor controller for controlling the motor by using the calculated moving distance and the predetermined value.

9. The apparatus of claim 7, wherein the TPH driver comprises:

a printing determinator for determining whether a region to be printed remains on the medium; and a driver for moving the TPH in the transverse direction by a predetermined value if the region to be printed remains on the medium.

10. The apparatus of claim 9, wherein the predetermined value comprises a transverse length of the TPH.

11. A printing apparatus using a thermal print head (TPH), the apparatus comprising:

a feeder for feeding a medium in a positive and negative longitudinal direction;

a TPH for printing an image by heating the medium fed by the feeder; and a TPH driver for moving the TPH in a transverse direction, wherein the TPH comprises:

a first TPH for heating the medium to print at least one of yellow, magenta, and cyan data; and a second TPH for heating the medium to print the data remaining except the data printed by the first TPH, wherein the TPH driver comprises:

a first TPH driver for moving the first TPH in the transverse direction; and a second TPH driver for moving the second TPH in the transverse direction.

12. A high quality printing method using thermal print head (TPH) printing an image by heating a medium, the method comprising:

(a) converting image data into data to be printed with a predetermined resolution;

(b) printing the converted data on the medium using the TPH while feeding the medium in a positive longitudinal direction;

(c) moving the TPH in a transverse direction by a predetermined value; and (d) printing the converted data on the medium using the TPH while feeding the medium in a negative longitudinal direction.

13. The method of claim 12, wherein, in operation (a), the image data is converted into the data to be printed with the predetermined resolution using a look-up table.

14. The method of claim 12, wherein, in operation (c), the TPH is moved in the transverse direction by a distance corresponding to 0.5 bit.

15. A computer-readable medium having recorded thereon a computer readable program for performing high quality printing of an image using thermal print head (TPH) printing by heating a medium, comprising:

a first set of instructions for converting image data into data to be printed with a predetermined resolution;

a second set of instructions for printing the converted data on the medium using the TPH while feeding the medium in a positive longitudinal direction;

a third set of instructions for moving the TPH in a transverse direction by a predetermined value; and a fourth set of instructions for printing the converted data on the medium using the TPH while feeding the medium in a negative longitudinal direction.

16. A computer-readable medium having recorded thereon a computer readable program for printing using a thermal print head (TPH), comprising:

a first set of instructions for printing an image on a medium using the TPH while feeding the medium in a longitudinal direction;

a second set of instructions for moving the TPH in a transverse direction by a predetermined value; and a third set of instructions for printing an image on the medium using the TPH while feeding the medium in a longitudinal direction, wherein the third of instructions comprises:

a set of instructions for calculating a transverse length of a region to be printed which remained on the medium and comparing the calculated transverse length with the transverse length of the TPH;

a set of instructions for printing an image on the medium using the entire portion of the TPH while moving the medium in the longitudinal direction if the calculated transverse length is larger than the transverse length of the TPH; and a set of instructions for printing an image on the medium using only a partial portion of the TPH corresponding to the calculated transverse length while moving the medium in the longitudinal direction if the calculated transverse length is smaller than the transverse length of the TPH.

* * * * *